US006010040A

United States Patent [19]

Duffield et al.

[11] Patent Number: 6,010,040

[45] Date of Patent: Jan. 4, 2000

[54] MOUNTING CUP FOR AN AEROSOL CONTAINER

[75] Inventors: Dean Walter Duffield, Camden; Charles Martin Tansey, Penshurst, both of Australia

[73] Assignee: Precision Valve Corporation, Yonkers, N.Y.

[21] Appl. No.: 09/161,846

[22] Filed: Sep. 28, 1998

[51] Int. Cl.[7] ..... B65D 83/00

[52] U.S. Cl. ..... 222/402.1

[58] Field of Search ..... 222/394, 402.1; 220/619, 620

[56] References Cited

U.S. PATENT DOCUMENTS

| | | | |
|---|---|---|---|
| 3,342,381 | 9/1967 | Simons et al. | 222/402.1 |
| 4,958,757 | 9/1990 | Greenebaum, II | 222/394 |
| 5,016,785 | 5/1991 | Greenebaum, II | 222/402.1 |
| 5,215,209 | 6/1993 | Radtke | 220/619 |

*Primary Examiner*—Gregory L. Huson
*Attorney, Agent, or Firm*—Kilgannon & Steidl

[57] ABSTRACT

In its broadest aspect, the improved mounting cup of this invention comprises a mounting cup having the skirt portion of the cup tapered slightly radially inward and, further, the skirt portion having a beveled outside terminal edge.

6 Claims, 2 Drawing Sheets

2A

MOUNTING CUP FOR AN AEROSOL CONTAINER

This invention generally relates to valve mounting assemblies for aerosol containers, said mounting assemblies being commonly referred to as "gasketed mounting cups." More particularly, this invention relates to an improved mounting cup, the mounting cup being the component of the valve mounting assembly that forms the closure of the aerosol container opening by clinching the mounting cup to the bead of the aerosol container. The particular improvement of this invention concerns a modification of the skirt portion of the mounting cup.

BACKGROUND OF THE INVENTION

Aerosol containers are widely used to package a variety of fluid materials, both liquid and powdered particulate products. Typically, the product and a propellant are confined within the container, at above atmospheric pressure, and the product is released from the container by manually opening a dispensing valve to cause the pressure within the container to deliver the product through the valve and connecting conduits to a discharge orifice.

The dispensing valve, crimped to a mounting cup having a sealing gasket, is normally mounted in a top opening of the container, which opening is defined by a component commonly referred to as the "bead" of the container opening. The mounting cup includes a central pedestal portion for holding the dispensing valve, a profile portion extending outward from the pedestal portion, which profile portion merges into an upwardly extending body portion, the body portion emerging into a hemispherically-shaped channel portion terminating in an outer skirt portion, which channel portion is configured to receive the bead portion of the container opening. The sealing gasket normally is disposed within the channel portion and in many gasket configurations extends downward along a part of the body portion. After the sealing gasket is disposed onto the mounting cup, the cup is positioned onto the container and the cup is clinched to the container. The clinching operation is well-known to those skilled in the aerosol container art.

Aerosol mounting cups are usually manufactured by stamping, drawing and, ultimately, cutting the mounting cup from a sheet of the metal fed to the die and cutting equipment. While the outer or skirt portion of the mounting cup is usually depicted in drawings thereof as being straight, the reality is that the cups of the prior art have a slightly outwardly flared skirt, the edge of which skirt is often burred. See FIG. 1.

The magnitude of the outward flare and burr can vary within the press tooling and is related to the tooling in the final trim and draw operation, i.e., trim and draw punch, trim and draw die, and the inner curling punch. The above problems are caused by the progressive wear and clearance between punch and die, e.g., new punches with standard clearance of 0.0015 maintain a sharper cut edge (minimum burr). However, during the course of production of large quantities, the formation of the flare and burr is a common occurrence.

The metal mounting cup is often coated with a thin protective plastic coating so as to protect the metal against the corrosive effects of the product to be stored within the aerosol container as well as the ambient conditions of the environment. In commerce, mounting cups, with or without valves, are loosely packed in boxes and shipped to another site for assembly with the other components of the valve mounting assembly and, subsequently, shipped to the party (filler) that fills the aerosol container with product and propellant and affixes, in a sealing relation, the valve mounting assembly and the filled container. In shipment, the mounting cups are free to move and to shift within their container with the consequence that the sharp outwardly flared, often burred, outer edge of the skirt portion of the mounting cup scratches the external tin coating on tinplate mounting cups, as well as the thin plastic and lacquer coatings on steel and aluminum cups.

Additionally, in the mass production of aerosol valves, the application of the gasket to the mounting cup and the assembly of the valve to the mounting cup involve moving the mounting cups in a continuous line along a track from station to station. As a consequence, adjacent mounting cups in the tracking line have essentially a point contact, i.e., flared edge to flared edge, when moving along the track, rather than the more desirable surface to surface contact of the skirt portion of each cup. Often, the point contact of the flared edges results in damage to the mounting cup.

SUMMARY OF THE INVENTION

An object of this invention is to provide an improved metal mounting cup for aerosol containers which avoids or minimizes the deficiencies of the prior art cups as discussed above.

These objectives and other advantages are attained through the use of the improved mounting cup of this invention.

In its broadest aspect, the improved mounting cup of this invention comprises a mounting cup having the skirt portion of the cup tapered slightly radially inward and, further, the skirt portion having a beveled outside terminal edge.

The mounting cup of this invention is formed by advancing a tapered cylindrical sleeve along the outer skirt portion of the mounting cup.

DETAILED DESCRIPTION OF THE DRAWINGS

Figure 1:
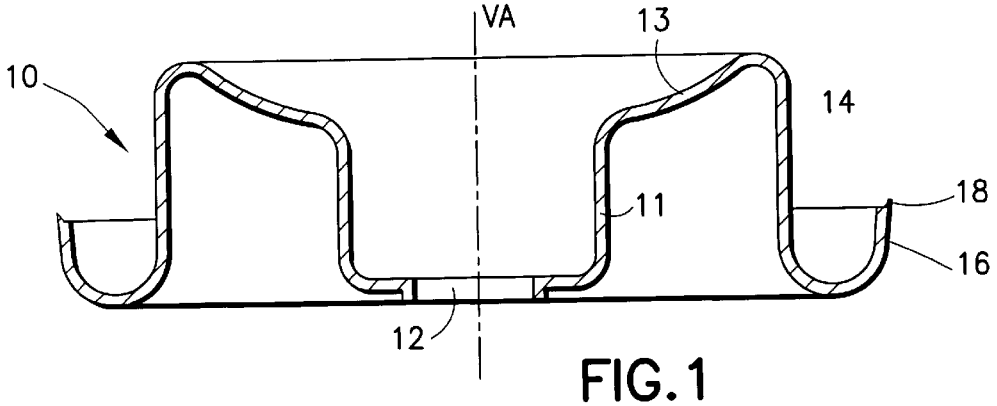
FIG. 1 PRIOR ART
FIG. 1 is an enlarged cross-sectional view of a prior art mounting cup.

FIG. 1 shows a mounting cup, generally designated as 10, having a pedestal portion 11 defining a central opening 12, a profile portion 13 merging into a body portion 14, and a curvilinear channel portion 15 having an outer skirt portion 16 terminating in edge portion 18.

Figure 2:
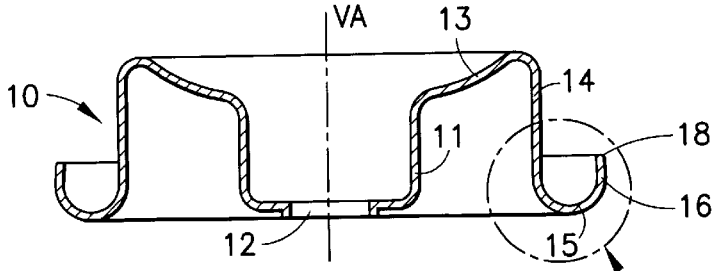
FIG. 2 is an enlarged cross-sectional view of the mounting cup of this invention.
Figure 2A:
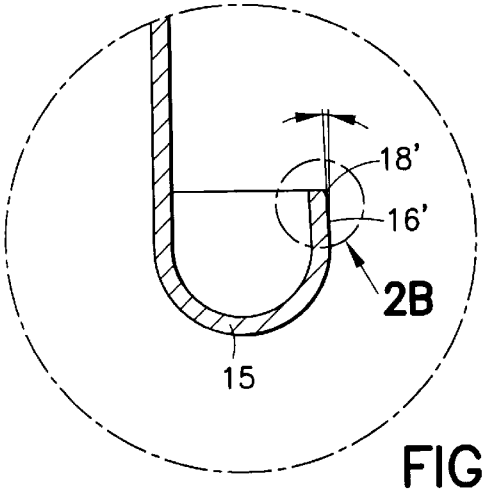
FIG. 2A is an enlarged view of the portion of the mounting cup of FIG. 2 within the circular dash lines.

In FIG. 2, the portions of the mounting are numbered as in FIG. 1, except that in FIG. 2, the outer skirt portion is $\mathbf{16}^1$ and the terminal edge of the outer skirt is $\mathbf{18}^1$.

In FIG. 1, the outer skirt portion 16 of the prior art mounting cup flares slightly outwardly to the vertical axis of the mounting cup (See VA in FIG. 1) and the terminal edge 18 of outer skirt 16 is burred.

Figure 2B:
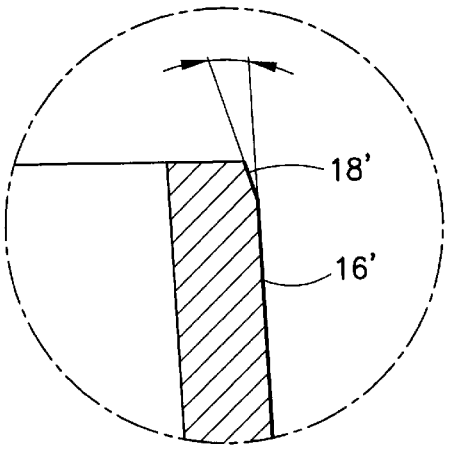
FIG. 2B is an enlarged view of the portion of the mounting cup of FIG. 2A within the circular dash lines.

In FIG. 2, the outer skirt portion $\mathbf{16}^1$ tapers slightly inwardly relative to the vertical axis of the mounting cup and the outer surface 20 (as best shown in FIG. 2B) of the terminal edge 18[1] is beveled.

In a preferred embodiment, the outer skirt portion of the mounting cup has an inward taper of 0.50° to 3° and the outer surface of the terminal edge of the outer skirt portion has a bevel of 15° to 22°.

In a most preferred embodiment, the outer skirt portion of the mounting cup has an inward taper of 3° and the outer surface of the terminal edge a taper of 20°.

Figure 3:
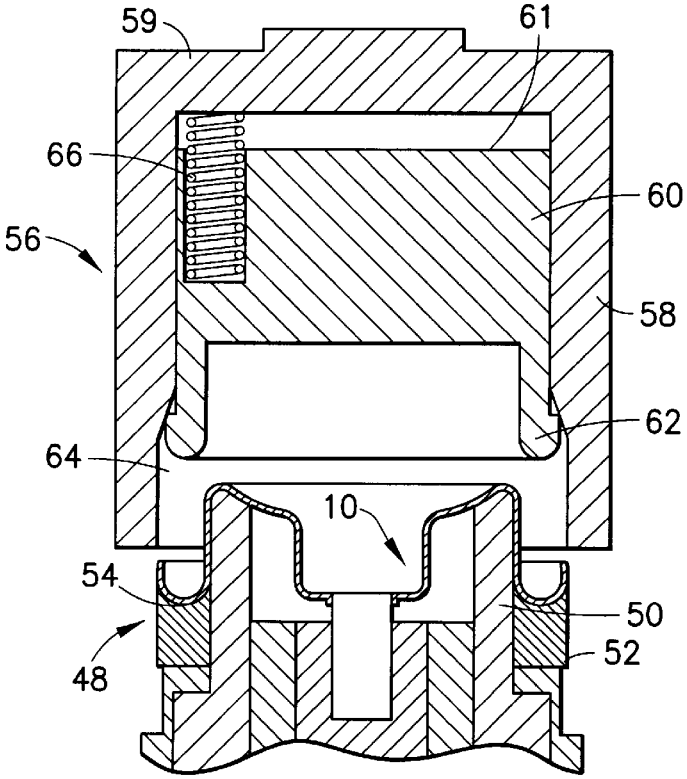
FIG. 3 is a partial cross-sectional view of the apparatus used to form the mounting cup of FIG. 2 in an open position.

In FIG. 3, the mounting cup, generally designated as 10, is shown disposed in a nesting location, generally designated as 48, where the body portion 14 of the mounting cup 10 is disposed over a cylindrical tube 50. An annular ring 52 has a recess 54 shaped to receive and support the channel portion 15 of the mounting cup 10.

Figure 4:
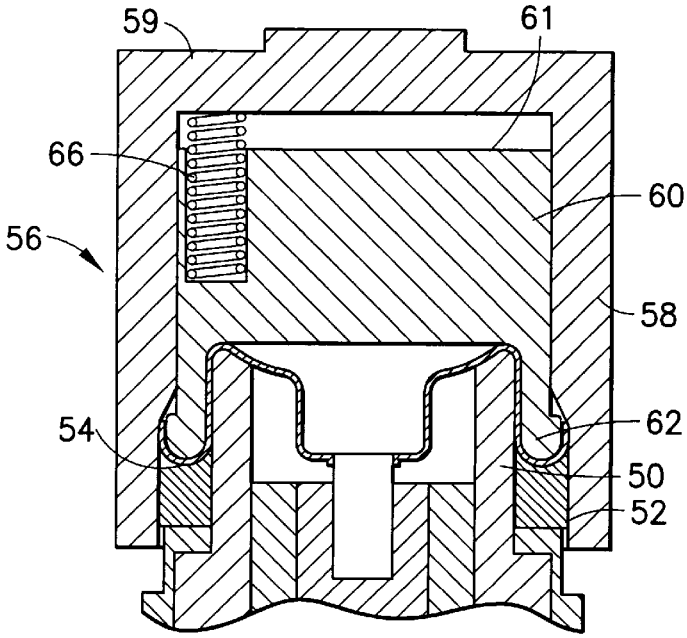
FIG. 4 is the apparatus of FIG. 3 in the closed position.

Situated above and aligned with the nesting location 48 is the tool that reshapes the skirt portion of the mounting cup. As shown, the tool, generally designated as 56, comprises an outer cylindrical sleeve punch 58 having a closed end 59, and an inner curling punch 60, the forward portion 62 of the curling punch 60 being configured to mate with the under surface of the channel portion 15, the body portion 14 and the skirt portion 16 of the mounting cup 10. The inner surface 64 of the open end of outer cylindrical sleeve 56 is slightly inwardly tapered, the taper terminating at its inner end in an inward taper of a greater degree. Spring 66 is disposed between the closed end 59 and inner curling punch 60. The progressive downward motion of the cylindrical sleeve punch and inner curling punch positions the mounting cup in the support nest. Reshaping of the mounting cup is accomplished by downwardly advancing the outer cylindrical sleeve punch 58 against the top surface 61 of the inner curling punch 60 after the inner curling punch 60 has been properly seated on the mounting cup as shown in FIG. 4.

In addition to the advantages discussed heretofore, the mounting cup of this invention provides the following additional benefits:

(a) During tracking of contiguous mounting cups during valve assembly or other operations, the actual contact area between mounting cups is effectively moved to a point on the outside radius of the skirt. At this point, it ensures each cup is contacting contiguous cups at the strongest point on the skirt wall, thereby eliminating denting of the terminal edge of the skirt which is often the case.

(b) Consistency of skirt profile and mounting cup outside diameter ensures more accurate centering or pitching of the cup (machine set up) during gasket valve assembly operations. This advantage is of major benefit particularly with the trend for higher speeds/output required from various assembly operations with minimum visual damage to the skirt area of the mounting cup.

(c) The improved skirt edge provides and avoids damage to the plastic retaining lugs of accessories (actuators) that are mounted onto the mounting cup, i.e., overcaps/spouts, etc.

(d) Further, the tapered skirt of the mounting cup of this invention enhances the retention of the cut gaskets (grommet) after positioning on the mounting cup for subsequent manufacturing operations prior to permanently affixing the mounting cup to the container.

Although specific examples of the invention have been shown for purposes of disclosure, it is to be understood that various modifications can be made therefrom without departing from the spirit and scope of the invention.

We claim:

1. In an aerosol mounting cup comprising a centrally disposed pedestal portion, a profile portion extending radially outward from the pedestal portion, and an upstanding annular body portion connected at its lower end to the profile portion and at its upper end to an annular curvilinear channel portion which terminates in an outer skirt portion, the improvement comprising a skirt portion being tapered toward the upstanding body portion and further having the outer surface of the terminal edge of the skirt being beveled.

2. The mounting cup of claim 1, and further wherein the surface of the mounting cup has a plastic coating.

3. The mounting cup of claim 1, and further wherein the taper of the skirt portion toward the upstanding body portion is between 0.50° to 3° and the outer surface of the terminal edge of the skirt has a bevel angle between 15° and 22°.

4. The mounting cup of claim 1, and further wherein the taper of the skirt portion toward the upstanding body portion is approximately 3° and the bevel of the outer surface of the terminal edge of the skirt is approximately 20°.

5. The mounting of claim 2, and further wherein the taper of the skirt portion toward the upstanding body portion is between 0.50° to 3° and the outer surface of the terminal edge of the skirt has a bevel angle between 15° and 22°.

6. The mounting cup of claim 2, and further wherein the taper of the skirt portion toward the upstanding body portion is approximately 3° and the bevel of the outer surface of the terminal edge of the skirt is approximately 20°.

* * * * *